United States Patent [19]

Halliburton et al.

[11] 4,429,876

[45] Feb. 7, 1984

[54] PINBALL MACHINE AND PLAY FEATURE THEREOF

[75] Inventors: Ronald D. Halliburton, Delray Beach; James H. Pearson, Oakland Park; Robert J. Sava, Miramar, all of Fla.

[73] Assignee: Bally Manufacturing Corporation, Chicago, Ill.

[21] Appl. No.: 334,316

[22] Filed: Dec. 24, 1981

[51] Int. Cl.[3] ..... A63F 7/02; A63F 7/30

[52] U.S. Cl. ..... 273/121 A; 273/127 C; 273/129 S

[58] Field of Search ..... 273/119 A, 119 R, 118 A, 273/120 A, 121 A, 121 R, 122 A, 123 A, 124 A, 125 A, 129 P, 129 S; 200/61.11, 61.1

[56] References Cited

U.S. PATENT DOCUMENTS

| | | | |
|---|---|---|---|
| 2,830,819 | 4/1958 | Pearl | 273/121 A |
| 3,180,645 | 4/1965 | Seiden et al. | 200/61.11 X |
| 3,559,991 | 2/1971 | Immendorf | 273/129 P X |
| 3,578,802 | 5/1971 | Murphy et al. | 273/121 A X |
| 4,065,129 | 12/1977 | Bartok | 273/121 A |
| 4,221,384 | 9/1980 | Krynski | 273/121 A X |
| 4,223,889 | 9/1980 | Konta | 273/121 A X |

*Primary Examiner*—Paul E. Shapiro

*Attorney, Agent, or Firm*—Welsh & Katz

[57] ABSTRACT

A pinball machine having a playfield on which at least one drop target is supported for selective actuation relative to the playfield. The drop target includes a post having a conical shaped flange at its upper end, the post being moveable between a position wherein the flange and a portion of the post are disposed above the playfield for impingement by a game ball, and being responsive to impact by the game ball for movement to a position wherein a planar surface on the upper flange is substantially flush with the playfield so as to enable the game ball to pass freely thereover. Movement of the drop target from its raised position to its lowered position upon impact by a game ball serves to propel the ball away from the target.

10 Claims, 4 Drawing Figures

PINBALL MACHINE AND PLAY FEATURE THEREOF

This invention relates to pinball games, and more particularly, to a pinball machine containing a novel play feature.

The design of the playfield of a pinball machine is critical to the commercial success of the pinball machine. To this effect an appropriate combination of play features are desirable to produce a game with an appealing play. Generally, a pinball machine having a challenging but controlled game format, with other operating features such as multiple player play, compound or bonus scoring systems, and bonus ball replays, will be accepted and will be in great demand in the marketplace. However, because experienced players become rather selective in the pinball game apparatus on which they play, the owners and therefore the suppliers of such apparatus are constantly looking for new game formats and new play features to add to the pinball machine which hopefully will appeal to both players and owners. In the past, play features have included any number of apparatus, such as roll over switches, spinner lanes, flippers, bumpers and drop targets.

Accordingly, it is an object of the present invention to provide a pinball machine containing a novel play feature.

Other objects of the invention in addition to that set forth above will become apparent to those skilled in the art from the following description taken in connection with the accompanying drawings wherein.

In playing a pinball game, the game ball movement is directed by the player, is rebound from side bumpers and targets, and is moved down the incline of the playfield responsive to gravity. Most targets, especially drop targets can only be activated by a ball striking the target from a fixed direction (not 360° responsive). This limits the responsiveness of the game. As described above, the ball moves about the playfield in many directions, and can at any given instant in time strike a target from any direction (360°).

In accordance with the present invention, an embodiment is disclosed of an improved drop target responsive to activation by a striking ball from any direction (360°). Once struck, the drop target (of the present invention) is caused to drop to be flush with the playfield (and is thus unable to be further activated), and points can be added/subtracted to the source. A downwardly tapering cone shaped flange member forming the upper portion of the drop target is caused to strike and propel the ball away from the drop target when the target is dropping. Responsive to a control signal, the drop target is raised back to the up (above the playfield) position and is once again ready to be responsive to a striking ball. The 360° target can be used stand alone or in combination with other targets of similar or dissimilar types.

The device of the present invention is embodied in a pinball machine comprising a downwardly inclined playfield, a ball, means for propelling the ball onto the playfield, one or more pivotally mounted flippers disposed near the playfield for affecting motion of the ball, and a novel play feature. The play feature comprises a drop target member having a post and a downwardly tapering frustrum of a right circular cone (flange member) atop the post, a first means for positioning the flange member and a portion of the above the playfield so as to position the target in an up position responsive to a control signal; and a second means for positioning the target beneath and flush with the playfield so as to allow the ball to pass thereover unobstructed responsive to the collision of the ball from any direction with the target when the target is in the up position. In accordance with another aspect of the present invention, the flange propels the ball away from the target member responsive to said second means positioning the target member from the up position to the down position.

Figure 1:
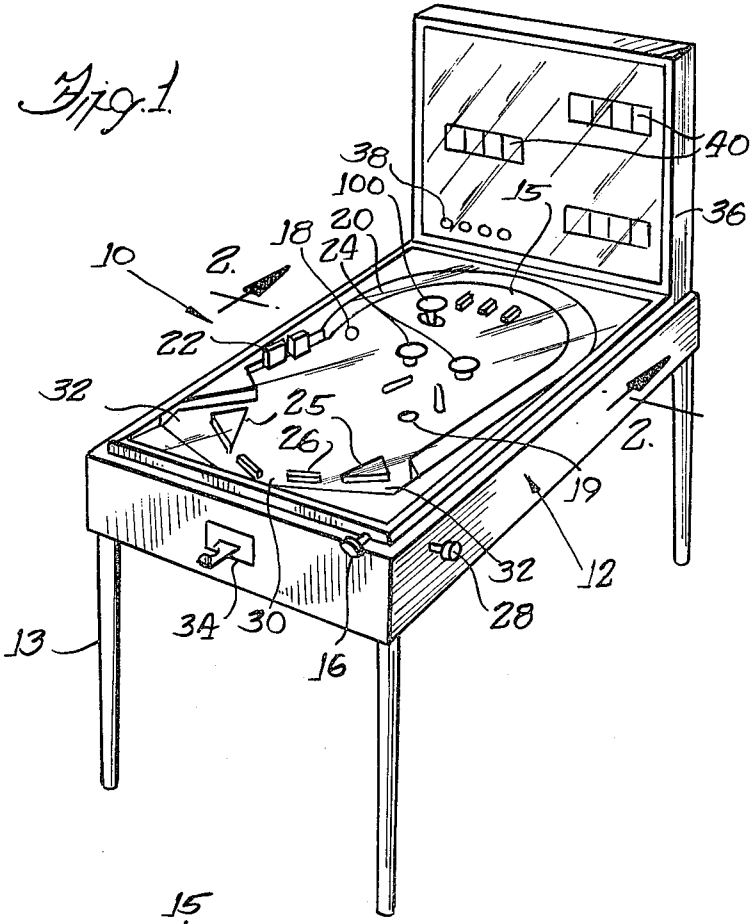
FIG. 1 is a perspective view showing a pinball machine containing the novel play feature of the present invention.

Referring more specifically to FIG. 1, the illustrated pinball machine 10 includes an upper cabinet 12 supported on legs 13 approximately at waist height to the usual game player. The cabinet 12 has a glass top beneath which is located a slightly inclined bordered playfield 15. A manual ball feeding mechanism 16 is located at the lower right-hand corner of the playfield and is used for ejecting a round ball 18 to the upper end of the playfield 15 at the start of play. The ball then rolls under the influence of gravity downwardly over the slightly inclined playfield against and past the various ball directing and target means located on the playfield. In the illustrated apparatus, some ball directing and target means shown include kick out holes 19, upper guide rails 20, spaced drop targets 22, thumper bumpers 24, slingshot kicker 25, and the novel play feature of the present invention, a 360° drop target, 100. Additionally, flippers 26 selectively controlled by manual left and right actuators 28 straddle a central out of play lane 30. A pair of side out of play lanes 32 are also defined on the sides of the playfield. In the typical game, once the ball passes through an out of play lane, it is lost and either a subsequent ball is then available to be put into play or the game is over. A coin mechanism 34 is located on the front of the cabinet to accept coins in the proper amount to enable play for the number of players desired. A back cabinet 36 is typically also provided, being glass covered and having suitable decorative and game operation material thereon. Thus, player indicating means 38 advises visually which player is playing, and the players' score area 40 provides continuous updated scores in digital display for the respective players. Other indicators can include a tilt notice, ball in play indicators and flashing score related lights not specifically identified.

The game apparatus may vary widely with respect to the particulars of the scoring as the ball moves about the playfield and against the various ball directing means and/or target means. Basically, however, each ball directing or target means, upon being hit by the ball, either redirects the ball, adds to the score of the player, or a combination of both. A control means as disclosed in the Nutting et al. U.S. Pat. No. 4,093,232 or in the Bracha et al. U.S. Pat. No. 4,198,051, both of which are incorporated herein by reference, can be provided for totaling the score and for illuminating the lights, according to some prearranged logic of the game apparatus as the ball caroms about the playfield.

Figure 2:
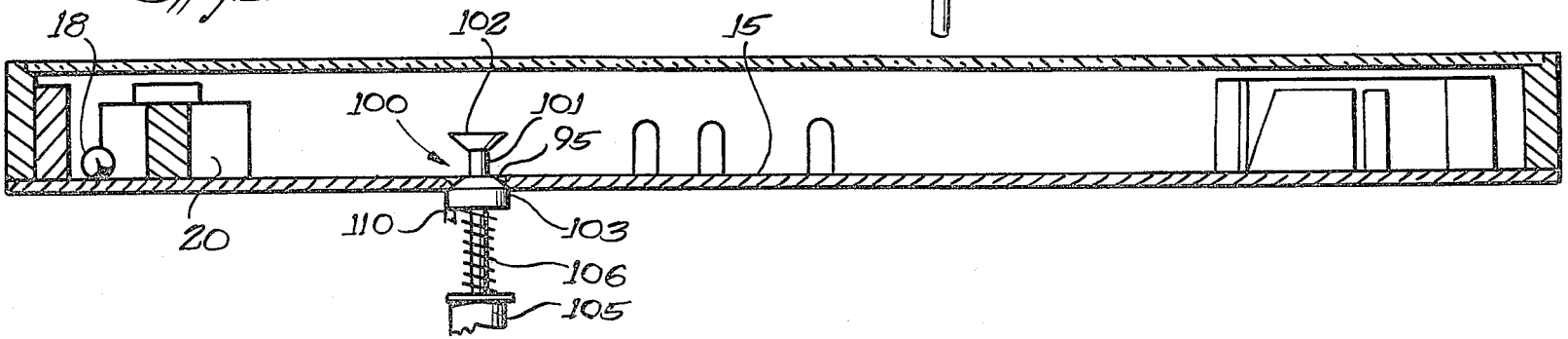
FIG. 2 is a partially broken away sectional view taken generally along the line 2—2 in FIG. 1 showing the novel play feature of the pinball machine.

In accordance with the present invention a play feature 100 is shown disposed above the playfield 15. As can be seen more clearly in FIG. 2, the play feature 100 comprises a target member 100 comprising a post 101 and a flange 102 atop the post. In the illustrated embodiment, the flange is a downwardly tapered cone shaped member. The target member 100 is securely supported above the playfield 15 by a solenoid arm 106 and solenoid 105. The playfield 15 has an opening 95 angularly notched on the sides so as to mate flushly with the tapered portion of the flange 102 with the target member 100 in the down position and so as to mate flushly with the portion of a bottom member 103 of the target member 100 with the target member in the up position. The bottom member 103 tapers and couples to the bottom of the post 101.

Figure 3:
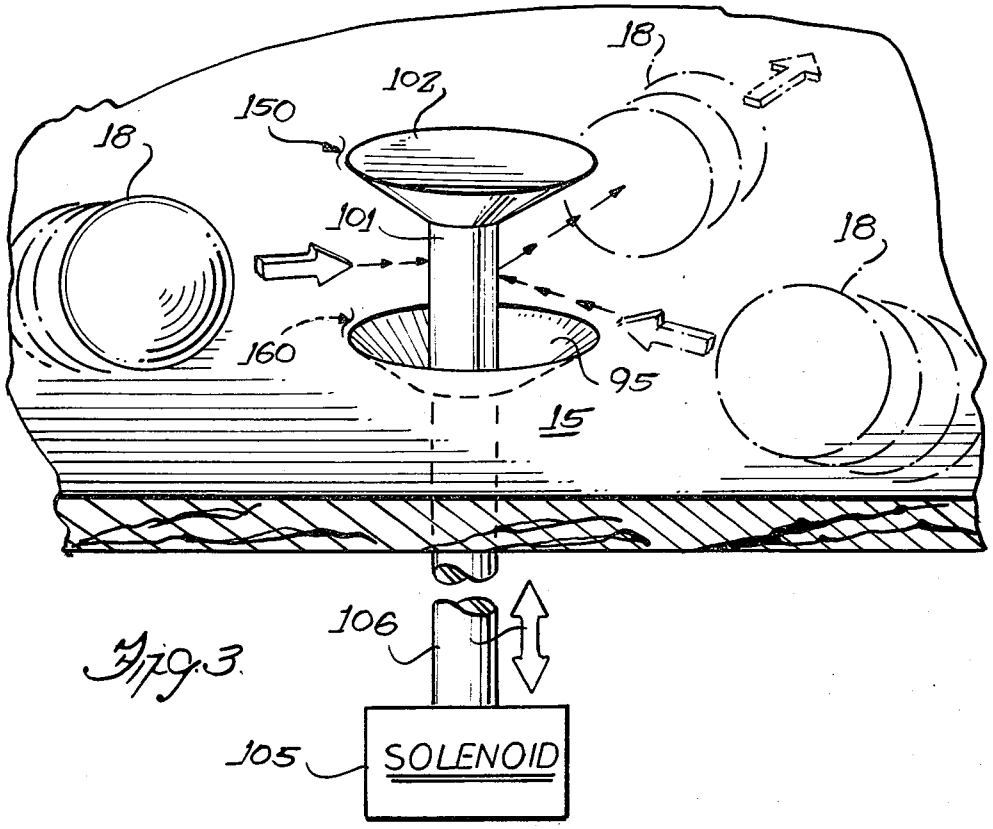
FIG. 3 is a side view, sectionally taken through the playfield, illustrating the operation of the novel play feature of the pinball machine.

Referring to FIG. 3, a drop target for use in a pinball machine having a playfield is shown. The drop target is comprised of a target body having a substantially flat top surface, which consists of a post and a flange attached to the top portion of the post. In the illustrated embodiment, the flange tapers (conically) from its flat top surface to the post. The post extends through a hole 95 in the playfield 15. The drop target 100 has an up position 150 and a down position (dotted) 160. When in the up position, the target body 101 and 102 extends above a top surface of the playfield and blocks the passage of the ball 18 rolling along the playfield from any direction.

The target 100 is moved from the up to down position responsive to the ball 18 striking the post (101) or the flange member 102 of the target 100.

When in the down position, the target post 101 and body 102 is substantially below the top surface of the playfield, and the top surface of the target body portion 102 is substantially coplanar with the top surface of the playfield 15 such that the ball 18 can roll freely over the target with the drop target in the down position. The drop target in its operational form is further comprised of a means (109 of FIG. 4) for detecting when the ball 18 rolling along the playfield 15 has struck the target 100 when the drop target is in the up position. A solenoid 105 in conjunction with solenoid arm 106 provides a means for forcing the drop target from the up position to the down position responsive to the means for detecting. Furthermore, a means is provided for resetting the drop target from the down position to the up position, such as responsive to a control signal.

In accordance with another aspect of the present invention, the flange 102 attached to the top position of the post 101 is shaped so that when the ball 18 rolling along the playfield 15 comes in contact with the target post 101 and body 102 of the drop target (when in the up position), the movement of the drop target from the up position to the down position causes the flange 102 to contact and propel the ball 18 away from the target body.

FIG. 3 illustrates one of the novel features of the present invention. The drop target 100 is activatable for movement from the up position to the down position responsive to the collision of the ball 18 with the target 101 and 102 from any direction i.e., from 360° around the drop target).

Figure 4:
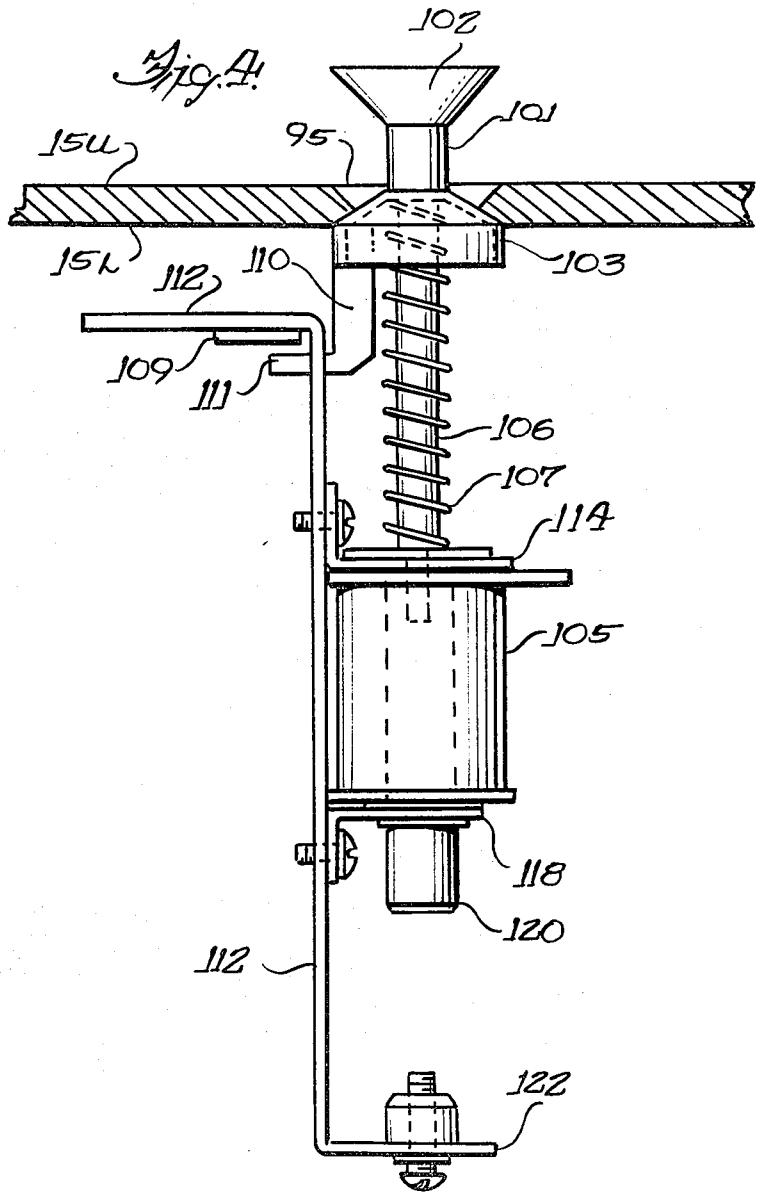
FIG. 4 is a side assembly view of the novel play feature of the pinball machine of the present invention.

Referring to FIG. 4, a side view of the drop target is shown, detailing the assembly of the illustrated embodiment of the present invention. The playfield 15 is comprised of an upper surface 15U upon which the ball 18 travels, and a lower surface 15L underneath which functional parts are mounted. The playfield 15 has a tapered opening 95, such that the flange 102 is flush with the playfield upper surface 15U when the drop target is in the down position. In the illustrated embodiment, the opening 95 is tapered so as to also provide that the bottom member 103 is flush with the playfield lower surface 15L when the drop target is in the up position.

The solenoid arm 106 is coupled to the post 101 for coincidental movement therewith. A spring 107 resiliently urges the drop target towards the up position. The spring 107 is coiled around the solenoid arm 106 and is positioned between the solenoid 105 and the bottom member 103. An L-member (110 and 111) has an upper arm 110 coupled to the bottom member 103 for movement coincident therewith. The lower arm 111 is operatively coupled to the means 109 for detecting the collision of the ball 18 with the drop target post 101 and flange 102. The means 109 may be implemented as an electrical switch sensing closure of contacts, or sensing interruption of a light source-receiver path, or may be a hall-effect switch, or other compatible detecting means. In the illustrated embodiment, the collision of the ball 18 with the target 100 is detected responsive to the ball 18 striking and raising the flange 102, thereby raising the post 101, bottom member 103, and the L-member 110 and 111, thereby activating the means for detecting 109. The solenoid 105 is activated so as to lower the drop target 100 responsive to the activation of the means for detecting. In the illustrated embodiment, the solenoid 105 is activated responsive to an electrical stimulus output from the means for detecting 109. The drop target 100 is returned to the up position responsive to the resilient urging of the spring 107 when the solenoid is deactivated.

In an alternate embodiment, a control means (not shown) controls the activation of the solenoid 105 responsive to the means for detecting 109, and controls the deactivation of the solenoid 105 responsive to a control stimulus provided responsive to the game play and score. The control means may be such as that which is disclosed in the aforementioned Nutting et al. U.S. Pat. No. 4,093,232 and Bracha et al. U.S. Pat. No. 4,198,051 incorporated by reference, or may be comprised of other types of control means.

A bracket 112 secures the solenoid 105 and associated members 106, 107, 103, 102, and 101 to the frame of the pinball game. Alternatively, other means for securing may be utilized.

From the foregoing it should be appreciated that a pinball machine having a novel play feature has been described which enhances the player appeal of the pinball machine.

It should be understood that although certain preferred embodiments of the present invention have been illustrated and described, various modifications, alternatives and equivalents thereof will become apparent to those skilled in the art and, accordingly, the scope of the present invention should be defined only by the appended claims and equivalents thereof.

Various features of the invention are set forth in the following claims.

What is claimed is:

1. A drop target for use in conjunction with a playfield and a ball, comprising: a target member having a post and a flange atop the post, first means for positioning the flange and a portion of the post above the playfield so as to position the target in an up position responsive to a control stimulus and second means for positioning the target beneath and flush with the playfield so as to allow the ball to pass thereover unobstructed responsive to the collision of the ball from any direction with the target when the target is in the up position.

2. The drop target as in claim 1 further comprising means for providing said control stimulus.

3. The drop target as in claim 1 wherein said second means detects the collision of the ball with the target responsive to the ball striking and raising the flange.

4. The drop target as in claim 3 further characterized in that the flange propels the ball away from the target member responsive to said second means positioning the target member from the up position to the down position.

5. A drop target for use in a pinball machine having a playfield, comprising: a target body, having a top surface, which consists of a post and a flange attached to top portion of the post, the post extending through a hole in the playfield, wherein the drop target has an up position and a down position, the target body extending above a top surface of the playfield so as to block the passage of a ball rolling along the playfield from any direction when in the up position, the target body being substantially below the top surface of the playfield with the top surface of the target body being substantially coplanar with the top surface of the playfield whereby a ball can roll freely over the target with the drop target in the down position; means for detecting when a ball rolling along a playfield has struck the target body when the drop target is in the up position, means for forcing the drop target from the up position to the down position responsive to the means for detecting; and means for resetting the drop target from the down position to the up position.

6. The drop target of claim 5 wherein the flange attached to the top portion of the post is shaped so that when a ball rolling along the playfield comes in contact with the target body of a drop target when in the up position, the means for forcing moves the drop target from the up position to the down position, causing the flange to contact and propel the ball away from the target body.

7. A pinball game comprising: a playfield, a ball, a target member having a post and a flange atop the post, first means for positioning the flange and a portion of the post above the playfield so as to position the target in an up position responsive to a control stimulus; and; second means for positioning the target beneath and flush with the playfield so as to allow the ball to pass thereover unobstructed responsive to the collision of the ball from any direction with the target when the target is in the up position.

8. The pinball game as in claim 7 further comprising: means for providing said control stimulus.

9. The pinball game as in claim 7 wherein: said second means detects the collision of the ball with the target responsive to the ball striking and raising the flange.

10. The pinball game as in claim 9 further characterized in that the flange propels the ball away from the target member responsive to said second means positioning the target member from the up position to the down position.

* * * * *